US005687498A

United States Patent [19]

Keyser et al.

[11] Patent Number: 5,687,498

[45] Date of Patent: Nov. 18, 1997

[54] DISPLAY APPARATUS FOR CHANGEABLE SIGN

[75] Inventors: William W. Keyser; David B. Keyser, both of Evergreen Park, Ill.

[73] Assignee: Florida Plastics International, Inc., Evergreen Park, Ill.

[21] Appl. No.: 504,254

[22] Filed: Jul. 19, 1995

[51] Int. Cl.[6] ..... G09F 11/08

[52] U.S. Cl. ..... 40/518; 40/471

[58] Field of Search ..... 40/518–522, 117, 40/471, 483, 777, 778

[56] References Cited

U.S. PATENT DOCUMENTS

| | | | |
|---|---|---|---|
| 1,182,952 | 5/1916 | Wilke | 40/471 X |
| 3,159,937 | 12/1964 | Barnes | 40/518 X |
| 4,965,947 | 10/1990 | Zanetti | 40/518 X |
| 5,174,055 | 12/1992 | Aiken | 40/518 |
| 5,410,830 | 5/1995 | Aiken, Sr. | 40/518 |

*Primary Examiner*—Kenneth J. Dorner
*Assistant Examiner*—Cassandra Davis
*Attorney, Agent, or Firm*—Gardner, Carton & Douglas

[57] ABSTRACT

A display apparatus for presenting changeable signage appropriate for use with backlit sign frames. Information-bearing inserts are supported in pockets on a display film which has a plurality of transparent panes through which the inserts may be displayed. Each end of the display film is loosely wound around a roller, and the remainder of the display film can be viewed through a translucent front display window. The rollers are coupled with multilink endless chain and are mounted on brackets which also support the display windows. The front window is hinged to allow it to be swung open for access to the display film for changing the inserts and for scrolling the display film so that a different set of inserts is visible through the display window. The display apparatus is supported by an existing sign frame through the use of fasteners spaced along the brackets and along the perimeter of the existing sign frame.

3 Claims, 3 Drawing Sheets

S T O P
S T O P
10
11
13
16,17
18
19
23
24
30
37
38
39
40
41
42
43
45
7
8

DISPLAY APPARATUS FOR CHANGEABLE SIGN

BACKGROUND OF THE INVENTION

This invention relates generally to a display apparatus for presenting changeable signage, and more particularly concerns a scrolling sign that can efficiently and inexpensively be installed in existing sign frames. It provides a convenient method for changing the information that is displayed on the sign, and it permits particular arrays of information on the sign to be selected for display or for concealment at any given time.

Translucent graphic images in backlit signs are commonly used as a means of displaying menu selections in restaurants. Frequently, the signs used for menu items at fast-food restaurants do not have sufficient space to advertise all of the special menu items and combinations offered at a restaurant at any given time. Use of this limited menu display space could be maximized if the sign could display a different set of menu selections at different meal times. In addition, many restaurants do not want to display menus for food that is not currently available. For example, the breakfast menu should be concealed in the afternoon when the breakfast selections are not available. At the same time, it would be beneficial if the frequent changes to menu selections and pricing could be accomplished by allowing the graphic to be easily replaced for selected menu items while other menu choices remained unchanged. Further, it would be advantageous for such a sign to be cost-effective by utilizing existing equipment (such as sign frames, light boxes, and graphic inserts) and by being relatively inexpensive to manufacture and maintain.

Scrolling signs have been introduced, such as that disclosed in U.S. Pat. No. 5,016,371 issued to Robert B. Aiken. However, these signs do not easily provide for the introduction and deletion of selected menu items, and they are expensive and bulky. Other signs that allow individual menu items to be easily changed, such as that disclosed in U.S. Pat. No. 4,367,604 issued to Stephen T. Porter II and Paul G. Gaiser, allow for only a limited number of menu selections.

It is an object of the present invention to provide a display apparatus that will allow individual graphics to be easily added, removed, or moved while providing a simple method to change which of the graphics are visible at any given time.

A further object is to provide a display apparatus that offers an expanded choice of graphics to be presented but which fits into the space provided by existing back-lit sign frames.

Another object is to provide a display film that is capable of retaining graphic inserts in such a manner that the retainers are not visible when the film is back-lit but in a way that the inserts may be easily added or removed.

A correlated object is to provide a display film that is capable of retaining graphic inserts in such a manner that the inserts may be wound and unwound with the film onto film scrolling rollers.

Also, an object is to provide a scrolling display apparatus that can be fitted into an existing vertical or tilted sign frame that was designed for use with signs that do not move.

An additional object is to provide a sign that allows for easy access to the displayed information so that the graphics to be displayed may be added, removed, or manipulated without dismantling the sign or removing the display apparatus from the frame on which it is mounted.

Yet another object is to provide a scrolling display apparatus that is relatively light-weight and inexpensive, with a minimum of parts for easy manufacture, installation and maintenance, yet is attractive and reliable.

Other objects and advantages of the invention will become apparent upon reading the following detailed description and upon reference to the drawings.

SUMMARY OF THE INVENTION

Briefly described, the present invention includes a display film with a plurality of pockets that support information-bearing inserts which are visible through a corresponding plurality of transparent panes in the display film. Each end of the display film is loosely wound around a roller, and the remainder of the display film can be viewed through a translucent front display window. The rollers are coupled with a multilink endless chain and are mounted on brackets which also support the display windows. The front window is hinged to allow it to be swung open for access to the display film for changing the inserts and for scrolling the display film so that a different set of inserts is visible through the front display window. The display apparatus is supported by an existing sign frame through the use of fasteners spaced along the brackets and along the perimeter of the existing sign frame.

DESCRIPTION OF THE DRAWINGS

The present invention may more readily be understood by reference to the accompanying drawings, throughout which the reference numerals refer to like parts. In the drawings.

DETAILED DESCRIPTION

While the invention will be described in connection with a preferred embodiment, it will be understood that it is not the intent to limit the invention to this embodiment. On the contrary, the intention is to cover all alternatives, modifications and equivalents as may be included within the spirit and scope of the invention.

Figure 1:
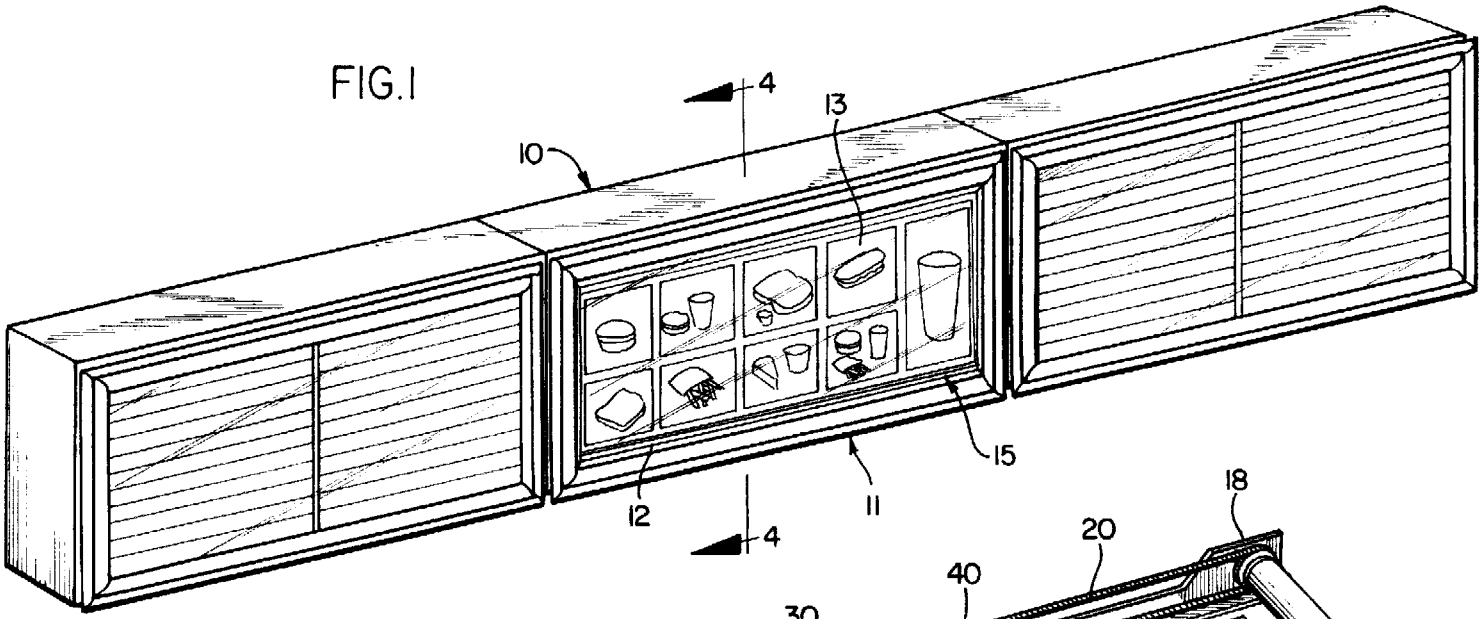
FIG. 1 is a perspective view of a backlit sign with graphic inserts used to display menu information, the frame of which the present invention may be fitted into to replace the non-scrolling display.

Turning first to FIG. 1, there is shown a back-lit sign 10. The sign 10 includes a sign frame 11 surrounding a display window 12. An insert 13 is a translucent card containing graphics and alpha-numeric information suitable for being illuminated from behind. The insert can be a sheet of translucent plastic imprinted with a photograph and descriptive information. In a conventional menu board, the inserts are held by a rigid panel which is fixedly attached to the sign frame.

Figure 2:
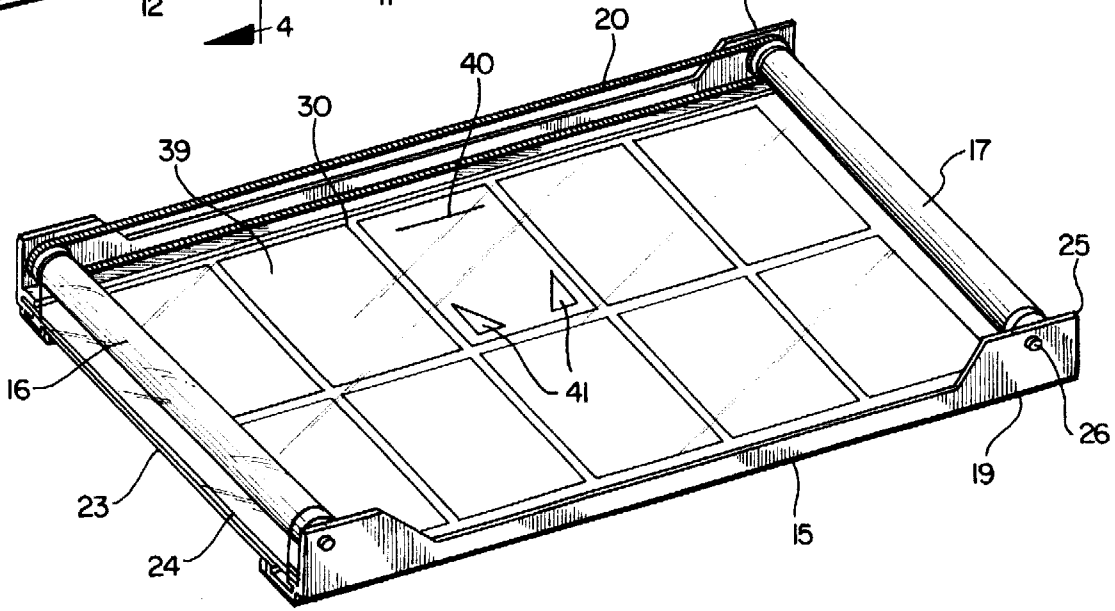
FIG. 2 is a perspective view of the rear of the display apparatus.
Figure 3:
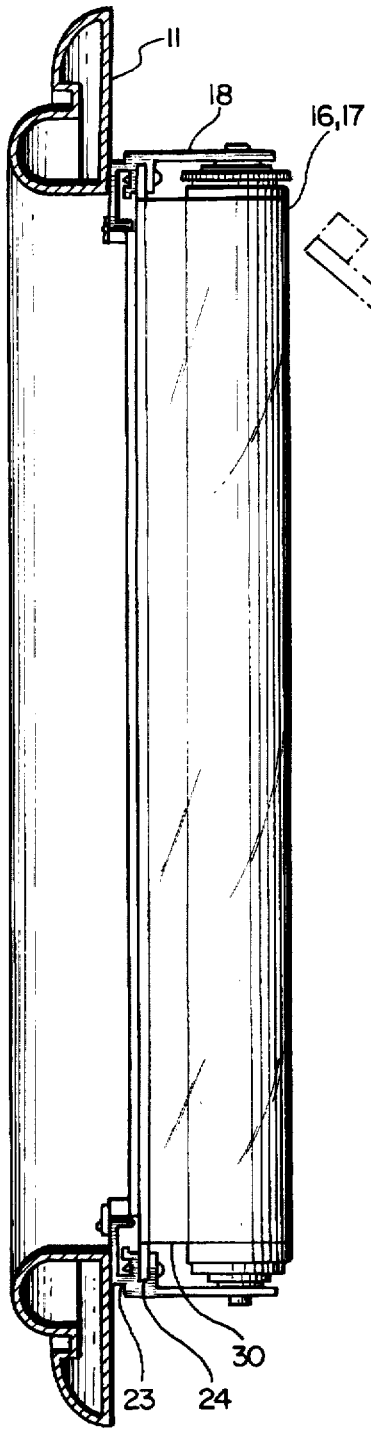
FIG. 3 is a side elevational view of the display apparatus as attached to a sign frame.

FIG. 2 shows the back of the present invention, comprising a display apparatus 15, which replaces a display window and a rigid panel in the sign 10. A first roller 16 and a second roller 17 are journalled parallel to one another on two identical confronting spaced brackets 18 and 19. In accordance with one aspect of the invention, a drive such as a multilink endless chain 20 couples the rollers 16 and 17 so that when a torque is applied to one of the rollers, an equal, simultaneous and controlled rotation occurs in both of the rollers. A display film 30 has a first end 37 attached to and loosely wound around the first roller 16. The middle of the display film 30 is loosely retained between a front window 23 and a rear window 24, and extends the length of the windows so that it is visible for display through the front window 23. The second end 38 of the display film 30 is loosely wound around and attached to the second roller 17. To allow a different portion of the display film 30 to be displayed through the front window 23, a force may be applied to the display film 30 in a direction generally perpendicular to the rollers 16 and 17 but generally coplanar with the display film 30 as it is extended along the length of the windows 23 and 24. This produces a torque which rotates the rollers 16 and 17 and causes the display film 30 to be wound up on one roller and unwound from the opposite roller.

Figure 4:
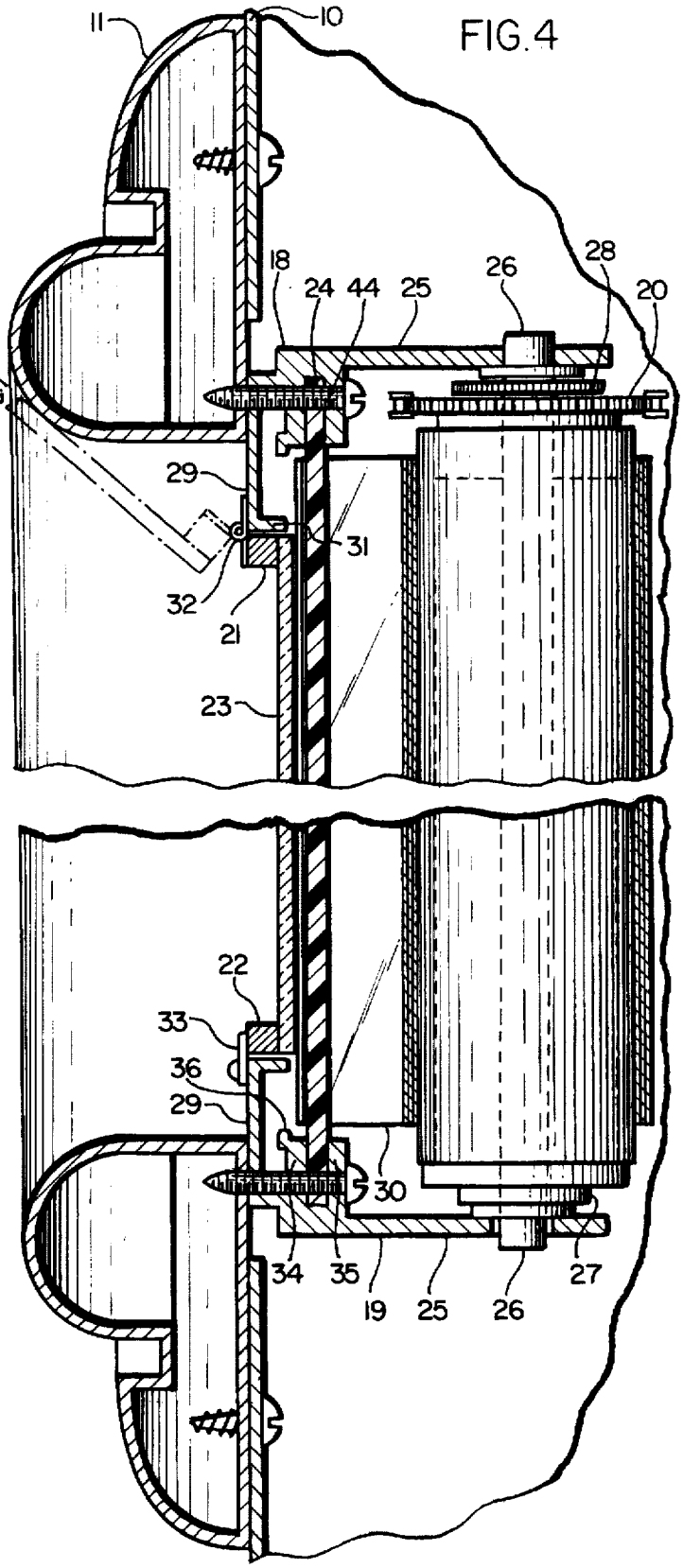
FIG. 4 is an enlarged sectional side elevational view of the display apparatus taken along the line 4—4 of FIG. 1, more particularly illustrating the film roller, bracket, and display window assemblies.

In carrying out the invention and as shown most clearly in FIG. 4, the brackets 18 and 19 each have coplanar extensions 25 which define holes that support the two axles 26, on which rollers 16 and 17 are journalled. To permit smooth rotation of the rollers 16 and 17, each of the rollers are mounted on a roller bearing 27 on the end of the axle 26 that is supported by the second bracket 19. In order to engage the links of the multilink chain 20, the end of each roller that is supported by the axle 26 in the first bracket 18 is fitted with a sprocket 28.

Figures 5, 6, 7, 8, 9:
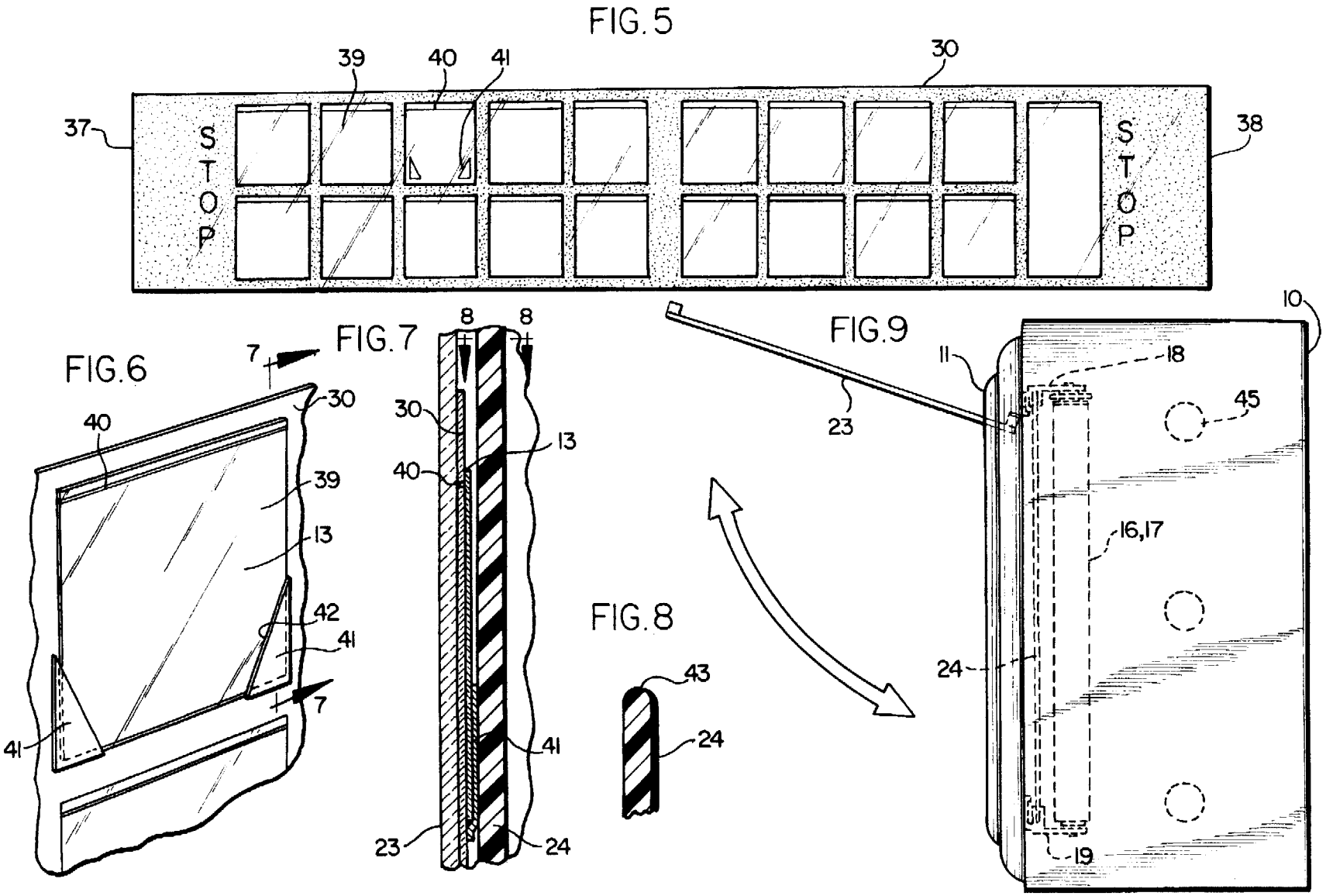
FIG. 5 is a front view of the display film.
FIG. 6 is an enlarged fragmentary perspective view of the back of the display film illustrating the display film pockets.
FIG. 7 is a fragmentary sectional view of the side of the display film and display windows taken along the line 7—7 of FIG. 6, illustrating the front and rear display windows loosely retaining the display film and the display film pocket retaining a graphic insert.
FIG. 8 is an enlarged sectional top view of the rear window, taken along the line 8—8 of FIG. 7, illustrating the filleted edge of the rear window.
FIG. 9 is a side elevational assembly drawing of the display apparatus fitted into the back-lit sign frame, particularly showing the hinged motion of the front display window of the apparatus.

To support the front window 23, the first bracket 18 has a bezel 29 that supports a hinge 32 which is attached to a ledge 21 which runs the length of the top edge of the front window 23. To maintain the alignment between the front window 23 and the rear window 24 by preventing the front window 23 from swinging back towards the rear window 24, a shelf 31 is attached to the bezel 29 to retain the ledge 21. To hold the front window 23 in a position generally parallel to the rear window 24 the bezel 29 is used in the second bracket 19 to support a pair of fasteners 33 which oppose a ledge 22 along the bottom edge of the front window 23. The fasteners 33 pivot to free the bottom of the front window 23 to allow the front window 23 to swing into and out of position, as indicated in FIG. 4 and FIG. 9. In this way the front window 23 may be easily moved out of position to allow access to the display film 30, and then simply swung back into position and secured with the fasteners 33. The front window 23 is transparent so that the display film 30 is visible through it.

As shown in FIG. 4, the rear window 24 is supported in a position generally coplanar to and aligned with the front window 23 but set back from the front window 23 by two spaced apart parallel legs 34 and 35 on the brackets 18 and 19. A plurality of fasteners 44 secure the rear window 24 to the legs 34 and 35. The display film 30 is loosely retained in this space between the windows 23 and 24, and is further held in position by a lip 36 that extends from the front leg 34. The rear window 24 is at least translucent so that a light source 45 located behind the window 24 may transmit light through the window 24 to illuminate the display film 30.

In accordance with another aspect of the invention, the display film 30 has a permanent curl set which allows it to easily be loosely wound around the rollers 16 and 17. As illustrated by FIG. 5, the display film 30 has a plurality of spaced apart transparent panes 39 through which the information-bearing inserts 13 may be displayed. In order to support the inserts 13 in a position generally parallel to the display film 30 for viewing through the transparent panes 39, each pane 39 has a pocket formed by a linear slit 40 and a pair of transparent retainers 41. FIG. 6 shows that the slit 40 is located near the top of the pane 39 to allow the insert 13 to be slid through the slit 40 and positioned behind the display film 30. The transparent retainers 41 are affixed to the back of the display film 30 in confronting alignment near opposite bottom corners of the pane 39. Each retainer 41 is generally shaped as a right triangle, with the first and second legs of the triangle being mounted on the display film 30 in alignment with the corner of the pane 39, and a hypotenuse 42 of the retainer 41 remaining unattached to the display film 30 so that the corners of the insert 13 may fit between the retainer 41 and the display film 30, as shown in FIG. 7.

As illustrated in FIG. 8, two edges 43 of the rear window 24 which are in alignment with the rollers 16 and 17 are filleted generally in conformance with the radius created in the display film 30 as it is guided from the rollers 16 and 17 over the rear window 24 and under the front window 23 to allow for the easy and smooth motion of the display film 30 as it is scrolled over the rear window 24.

To permit the display apparatus 15 to be used in signs that have either a vertical or tilted display, the display apparatus 15 is mounted directly to the sign frame 11. In accordance with this aspect of the invention, the brackets 18 and 19 have a plurality of holes in the bezel 29 through which the fasteners 44 that secure the rear window 24 are inserted to attach the brackets 18 and 19 to the sign frame 11. The brackets 18 and 19 are designed to utilize a minimum amount of material so that they may support the display apparatus 15, but are light-weight enough to be supported by the sign frame 11. As shown in FIG. 9, the mounted display apparatus is positioned in front of the lights 45 in the sign 10. When fitted with the display apparatus 15 in this manner, the sign 10 appears as it does in FIG. 1.

We claim:

1. A display film having a series of linear slits and a corresponding series of pairs of transparent retainers affixed to said film, each retainer pair comprising first and second triangular shapes in confronting alignment and defining pockets between the shapes and the film, said pockets being capable of supporting information-bearing inserts.

2. The display film according to claim 1 wherein the film has a permanent curl set and further includes a plurality of spaced apart transparent panes thereon.

3. A display film and film roller assembly comprising a display film having a permanent curl set and a plurality of spaced apart transparent panes thereon through which information bearing inserts may be viewed;

each transparent pane having a linear slit and a corresponding pair of retainers affixed to the display film, each retainer pair comprising first and second triangular shapes in confronting alignment, pockets being defined between the shapes and the film, said retainers being capable of supporting information-bearing inserts;

first and second spaced rollers, each journalled parallel to one another on a frame;

the display film having a first end attached to said first roller and a second end attached to said second roller, the ends of said film being loosely wound around the rollers; and drive means for creating equal, simultaneous, and controlled rotation of both rollers when a torque is applied to one roller.

* * * * *